United States Patent [19]

Yamada et al.

[11] Patent Number: 4,941,696

[45] Date of Patent: Jul. 17, 1990

[54] DOOR LOCK DEVICE FOR VEHICLE

[75] Inventors: Shinjiro Yamada; Shuji Nakamura, both of Utsunomiya, Japan

[73] Assignee: Mitsue Kinzoku Kogyo Kabushiki Kaisha, Tokyo, Japan

[21] Appl. No.: 322,877

[22] Filed: Mar. 14, 1989

[30] Foreign Application Priority Data

Mar. 14, 1988 [JP] Japan ..... 63-59843
Mar. 18, 1988 [JP] Japan ..... 63-65344

[51] Int. Cl.[5] ..... E05C 3/26

[52] U.S. Cl. ..... 292/340; 292/216; 292/341.12

[58] Field of Search ..... 292/216, 304, 341.12, 292/341.13, DIG. 40, DIG. 41, DIG. 56, DIG. 38

[56] References Cited

U.S. PATENT DOCUMENTS

| | | | |
|---|---|---|---|
| 3,206,240 | 9/1965 | Roethel | 292/216 |
| 3,331,624 | 7/1967 | Pugh | 292/216 |
| 4,165,112 | 8/1979 | Kleefeldt | 292/216 |
| 4,569,544 | 2/1986 | Escaravage | 292/216 |
| 4,756,563 | 7/1988 | Garwood et al. | 292/216 |

*Primary Examiner*—Richard E. Moore
*Attorney, Agent, or Firm*—Browdy and Neimark

[57] ABSTRACT

A door lock device for a vehicle has a striker secured to the vehicle body and a lock body secured to the door. A U-shaped rod of the striker has a horizontal portion and a pair of legs extending perpendicularly from the opposite ends thereof. The horizontal portion is provided with upper and lower engagement surfaces which become narrower as one goes toward the lock body. The lock body includes a first groove, into which the horizontal portion is advanced, and a second groove, into which at least one of the legs is advanced. The upper surface of the first groove is inclined to be parallel to the upper surface of the horizontal portion. The lower surface of the first groove is provided with a slide piece which is movable in the direction of movement of the striker. The upper surface of the slide piece is inclined to be parallel to the lower engagement surface of the horizontal portion. When the lock body and striker engage each other to be in a full-latch state, the horizontal portion is clamped between the upper surface of the first groove and the upper surface of the slide piece.

2 Claims, 5 Drawing Sheets

DOOR LOCK DEVICE FOR VEHICLE

BACKGROUND OF THE INVENTION

This invention relates to a door lock device for a vehicle and, more particularly, to a door lock device for a vehicle, which prevents rattling of the door when the door is closed.

Japanese Patent Publication Sho No. 58-13711 discloses a door lock device for a vehicle, which prevents rattling of a door in a closed state. Sho No. 58-13711 will now be described with reference to FIGS. 12 and 13. A door B is hinged by two, i.e., upper and lower, hinges C to a vehicle body A, and it is held in a closed state by the lock device D. The lock device D consists of a striker F secured to the vehicle body A and lock body J secured to the door B. The striker F has a wedge-like end, and the lock body J has a striker advancement groove E having a shape conforming to the shape of the striker F. Holding pieces I are each provided on each, i.e., upper or lower, side of the advancement groove E. When the striker F advances into the advancement groove E, the holding pieces I are brought into contact with the upper and lower surfaces of the striker F to hold the striker F elastically in the downward and upward directions.

With this structure, when the door B experiences external force in the direction of arrows X and/or Y, the movement of the door B is prevented by the elasticity of the holding pieces I.

With the above well-known structure, however, the holding pieces I are not moved in the direction of the advancement but is moved only in the vertical directions, and also they elastically hold the striker F. Therefore, the external force applied to the striker F in the direction of arrows X and/or Y surpasses the holding force of the holding pieces I, the door B is moved in the direction of arrows X or Y. If the elastic force of the holding pieces I is increased, the increased resistance of the rotation of the door B when the striker F is advanced into the groove E, deteriorates the feeling of closing the door B.

To provide for satisfactory feeling, it is desired to reduce the rotational resistance of the door B until the lock body J becomes fully latched and provide strong resistance when the lock body is fully latched, thus reducing the overrun of the door B beyond the fully latched position.

SUMMARY OF THE INVENTION

An object of the invention is to provide a door lock device for a vehicle, which can prevent movement of the door by the external force applied in the direction of arrows X and Y.

BRIEF DESCRIPTION OF THE INVENTION

Other objects of the invention will appear in the course of the description thereof, described by the way of example with reference to the drawings, in which.

DETAILED DESCRIPTION OF THE PREFERRED EMBODIMENT

Figure 1:
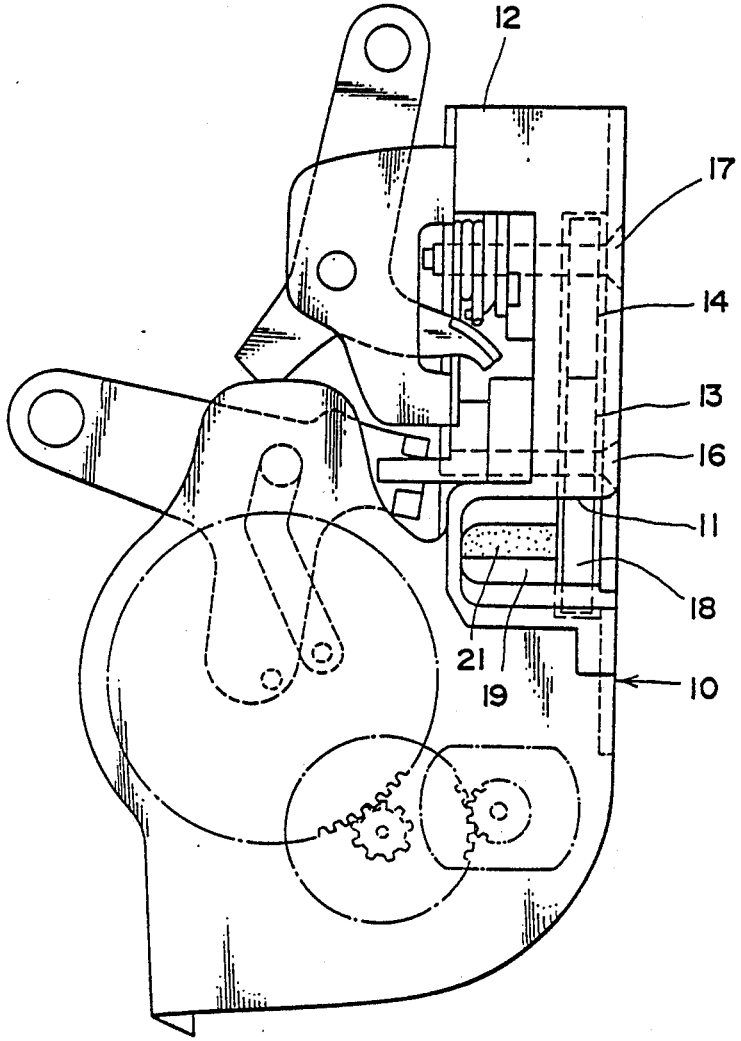
FIG. 1 is a side view showing a lock body according to the invention.
Figure 2:
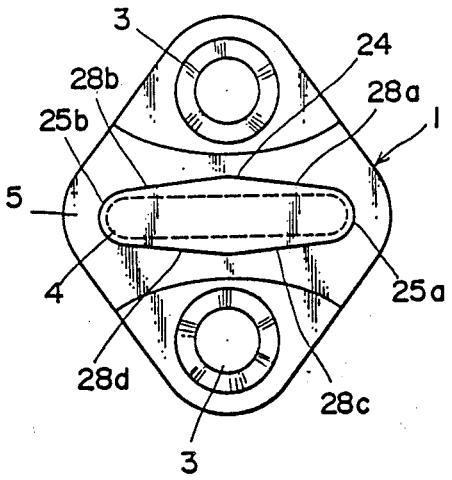
FIG. 2 is a front view showing a striker according to the invention.
Figure 3:
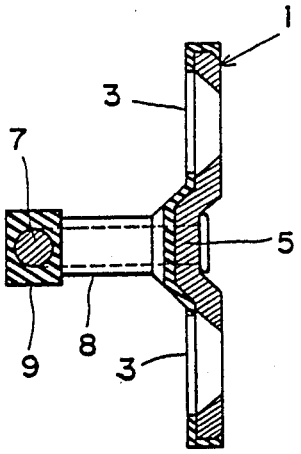
FIG. 3 is a longitudinal sectional view showing the same striker.
Figure 4:
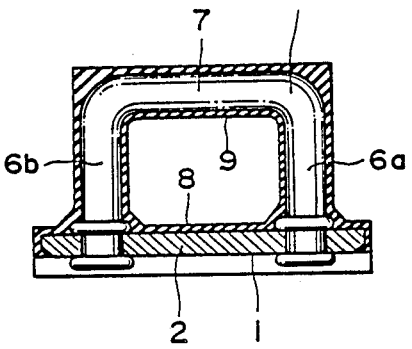
FIG. 4 is a transversal sectional view showing the striker.
Figure 5:
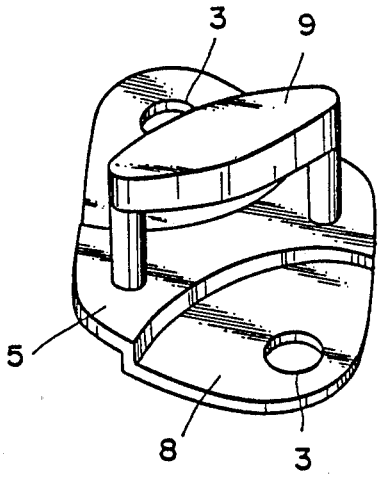
FIG. 5 is a perspective view showing the same striker.

Referring to FIGS. 2 to 5, a striker 1 has a base 2 with a central upward bridge 5. The base 2 also has a pair of mounting holes S each formed on each side of the upward bridge 5. A rod 4 provided on the base 2 has a horizontal portion 7 and a pair of legs 6*a*, 6*b* extending perpendicularly from the opposite ends of the horizontal portion 7. Thus, it has a substantially U-like shape. The legs 6*a*, 6*b* have their stems secured by thermal rivetting to the base 2. The base 2 and the rod 4 are coverd by an elastomer layer formed by molding. The elastomer layer B has a uniform thickness except for its portion covering the horizontal portion 7. The width of the elastomer layer 9 covering the horizontal portion 7 becomes greater as one goes toward the center 24 and smaller as one goes toward the opposite ends 25*a*, 25*b* of the horizontal portion 7, thus defining inclined contact surfaces 28*a* to 28*d*.

An elastomer body 12 of the lock device has a striker advancement groove 11 and a recess 15, in which a latch 13 and a ratchet 14 are rotatably mounted on respective pins 16 and 17.

The striker groove 11, as shown in FIG. 1, consists of a first advancement groove 10, through which the horizontal portion 7 of the striker 1 passes, and a second advancement groove 1B, into which one of the legs 6*a*, 6*b for engaging with the latch 13 is advanced.*

The upper surface 29 of the first groove 19 is inclined such that it extends parallel to the upper inclined surface 28*a* of the rod 4. The lower surface 26 of the first groove 19 is formed at an end with a recess 30, in which a slide piece 21 is accommodated. The upper surface 27 of the slide piece 21 is inclined to be parallel to the lower inclined surface 28*c* of the rod 4. When the striker 1 enters the groove 11, the upper surface 27 is engaged with the lower inclined surface 28*c* to cause displacement of the slide piece 21 along a guide pin 22 toward the terminal against the spring force of the coil spring 23. The inclination angle defined between the inclined contact surface 28*c* and upper surface 27 is set to a small angle, so that the slide piece 21 is not moved but is held stationary by the surface pressure even when the lock device 10 experiences an external force applied in the direction of arrows X and/or Y. Thus, when the slide piece 21 is pushed by the horizontal portion 7 so that the ratchet 14 is fully latched in engagement of the full latch groove 35 of the latch 13, both the upper and lower surfaces of the elastomer layer 9 of the horizontal portion 7 is clamped vertically by the upper surface 29 of the advancement groove 11 and the upper surface 27 of the slide piece 21, so that the door is not moved.

A cushioning member 20 is secured to be in a position at the terminal section of the first groove 10. The cushioning member 20 consists of a first elastic body 31 to be struck by the end 25*a* of the horizontal portion 7 and a second elastic body 32 to be struck by the free end 33 of the slide piece 21. The elastic bodies 31, 32 may be integral with each other or separate parts.

Figure 6:
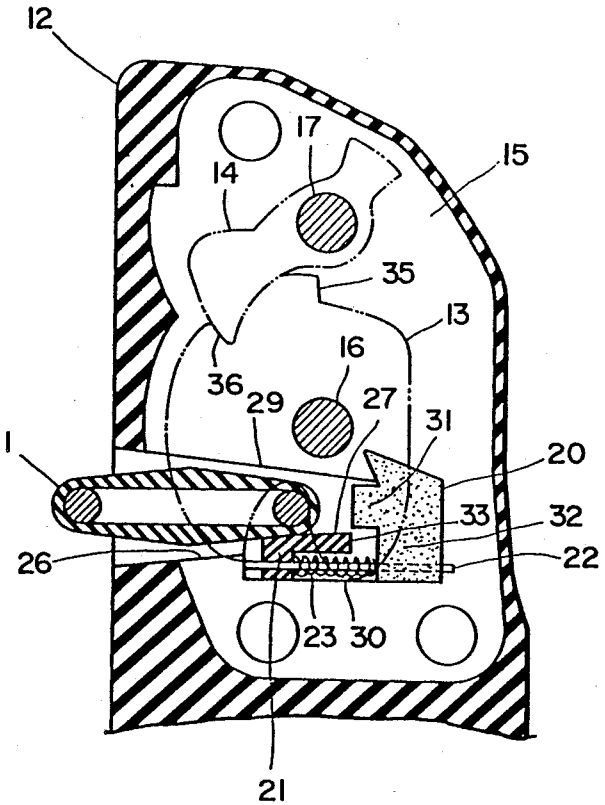
FIG. 6 is a view showing the striker in contact with the holding piece.
Figure 7:
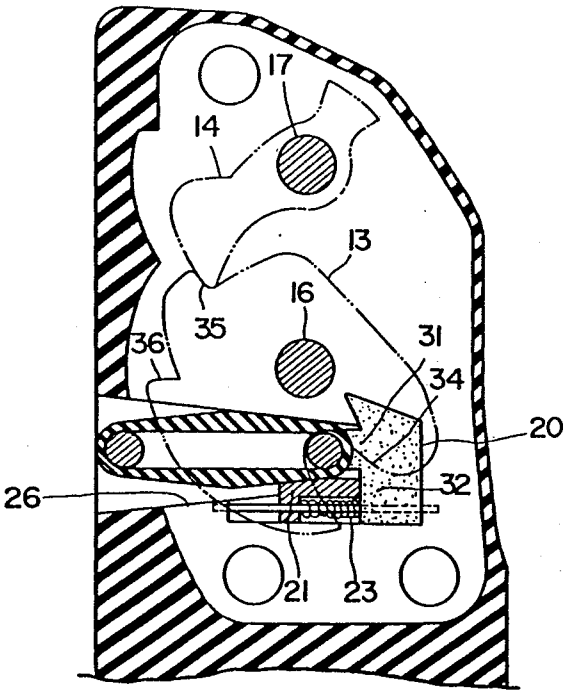
FIG. 7 is a view showing the striker in the fully latched state.
Figure 8:
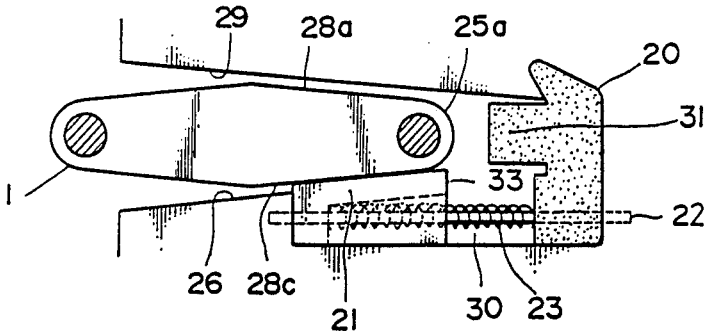
FIG. 8 is an enlarged-scale view showing the striker in contact with the holding piece.
Figure 9:
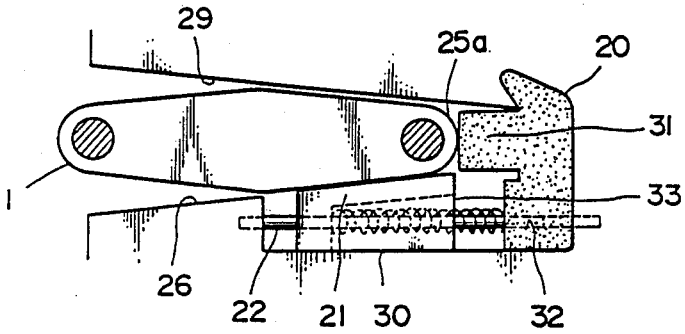
FIG. 9 is an enlarged-scale view showing the striker in contact with the first cushioning member.
Figure 10:
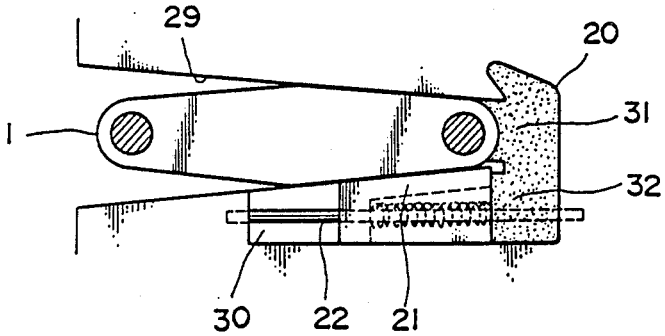
FIG. 10 is an enlarged-scale view showing the striker in the fully latched state.

The first and second elastic bodies 31 and 32, striker 1 and slide piece 21 are related to one another suck that at a half-latched position, at which the ratchet 14 is engaged in the half latch groove 36 of the latch 13, the free end 25*a* of the striker 1 is not contact with the first elastic body 31 and also the free end 33 of the slide piece 21 is not in contact with the second elastic body 32 (FIGS. 6 and 8), at a position intermediate between the half-latch position and full-latch position, at which the ratchet 14 is engaged in the full latch groove 35 of the latch 13, the free end 25*a* of the striker 1 engages with the first elastic body 31 (FIG. 9), and at the full-latch position, the free end 33 of the slide piece 21 is engaged with the second elastic body (FIGS. 7 and 10).

Figure 11:
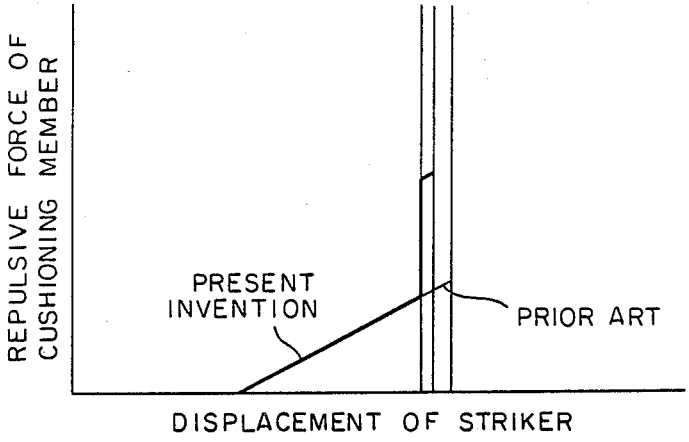
FIG. 11 is a graph with the ordinate taken for repulsive force of the cushioning member and the abscissa for the displacement of the striker.
Figure 12:
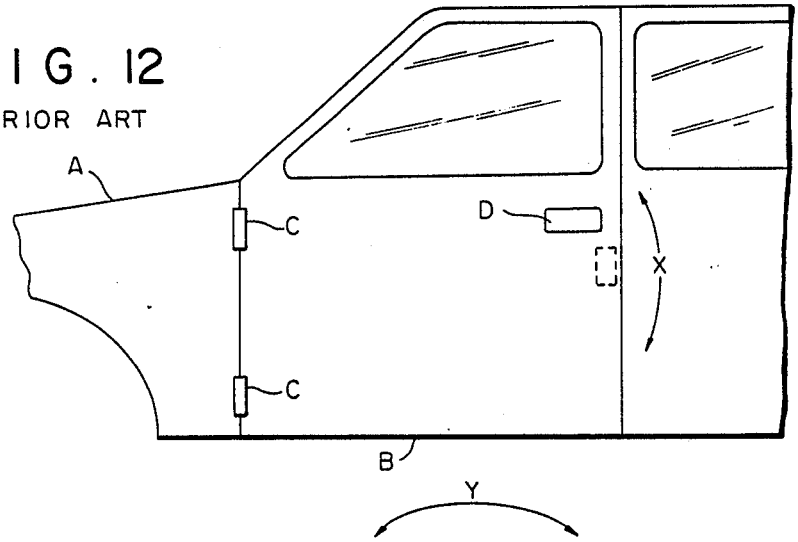
FIG. 12 PRIOR ART
FIGS. 12 and 13 are views showing a well-known door lock device for a vehicle.
Figure 13:
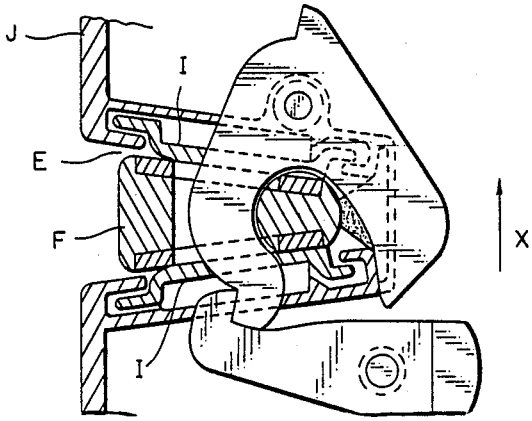
FIG. 13 PRIOR ART

FIG. 11 shows a graph with the ordinate taken for the repulsive force of the first and second elastic bodies 31, 32 and the abscissa for the displacement of the striker 1. As is shown, up to the full-latch position, only the repulsive force of the first elastic body 31 acts, so that the repulsive force increases linearly. After the full-latch the repulsive force of the second elastic body 32 is added, so that the repulsive force is increased sharply.

OPERATION

When the door is closed, the leg 6*a* of the striker 1 is advanced through the second groove 18 and is engaged in the engagement groove 34 of the latch 13 to cause rotation of the latch 13. The horizontal portion 7 is advanced through the first groove 19. The lower inclined contact surface 28*c* is engaged with the upper surface 27 of the slide piece 21 to cause displacement of the slide piece 21 to the inner side. When the striker 1 is advanced to the half-latch position, at which the ratchet 14 is engaged in the half-latch groove 36, the free end 25*a* of the striker 1 is not in contact with the first elastic body 31, and also the free end 33 of the slide piece 21 is not engaged with the second elastic body 32.

Further, when the striker 1 is advanced to an intermediate position between the half-latch position and the full-latch position as shown in FIG. 9, only the free end 25*a* of the striker 1 is engaged with the first elastic body 31, and the rotational torque of the door is gradually absorbed by the first elastic body 31.

When the striker 1 is further advanced, the free end 25*a* is wedged into the first elastic body 31 while receiving the repulsive force of the first elastic body 31, and at the full-latch position shown in FIG. 10, the free end 33 of the slide piece 21 is engaged with the second elastic body 32. At this position, usually considerable inertia remains in the door, so that the door undergoes overshoot beyond the full-latch position. This inertia is sharply absorbed by the contact between the slide piece 21 and the second elastic body 32, and the overshoot can be minimized.

More specifically, as shown in FIG. 11, up to the full-latch position only the repulsive force of the first elastic body 31 is acted. Thus, the force, with which the door is rotated up to the full-latch position may be reduced. Further, when strong torque to cause the door to rotate beyond the full-latch position is given, it is absorbed by the sudden repulsive force of the second elastic body 32. Thus, overshoot can be extremely minimized, and a high class sense when the door is closed can be obtained.

Further, when an external force acts on the door in the direction of arrow X or Y with the door in a perfectly closed state, the lock body 10 is not moved relative to the striker 1 for the cover layer 9 is clamped between the upper surface 20 of the groove 19 and the upper surface 27 of the slide piece 21.

What is claimed is:

1. A door locking device for a vehicle comprising a striker secured to the vehicle body and a lock body secured to a door and capable of engaging with said striker, said striker including a U-shaped rod having a horizontal portion and a pair of legs extending perpendicularly from the opposite ends of said horizontal portion, said horizontal portion having upper and lower engagement surfaces becoming narrower as one goes toward the lock body, the lock body having a first advancement groove, into which said horizontal portion is advanced, and a second advancement groove, into which at least one of said legs is advanced, said first advancement groove having an upper surface inclined to be parallel to the upper inclined surface of said horizontal portion and a lower surface provided with a slide piece movable in the direction of movement of said striker, said slide piece having an upper surface inclined to be parallel to the lower engagement surface of said horizontal portion, whereby with engagement of said lock body with said striker in the full-latch state the horizontal portion is clamped between the upper surface of said first advancement groove and the upper surface of said slide piece and wherein a terminal section of said first advancement groove is provided with a first elastic body engaged by said horizontal portion and a second elastic body engaged by said slide piece, said horizontal portion and said first elastic body are engaged with each other before said lock body is fully latched, and said slide piece and said second elastic body are simultaneously engaged with each other before the lock body is fully latched and wherein a terminal section of said first advancement groove is provided with a first elastic body engaged by said horizontal portion and a second elastic body engaged by said slide piece, said horizontal portion and said first elastic body are engaged with each other before said lock body is fully latched, and said slide piece and said second elastic body are simultaneously engaged with each other before the lock body is fully latched.

2. The door lock device for a vehicle according to claim 1, wherein U-shaped rod is a metallic round rod, and the upper and lower engagement surfaces of said horizontal portion are constituted by elastic molding.

* * * * *